US010066879B2

(12) United States Patent
Wei

(10) Patent No.: US 10,066,879 B2
(45) Date of Patent: Sep. 4, 2018

(54) HEAT EXCHANGE PLATE AND PLATE-TYPE HEAT EXCHANGER

(71) Applicant: DANFOSS MICRO CHANNEL HEAT EXCHANGER (JIAXING) CO., LTD., Zhejiang (CN)

(72) Inventor: Wenjian Wei, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 0 days.

(21) Appl. No.: 15/501,037

(22) PCT Filed: May 29, 2015

(86) PCT No.: PCT/CN2015/080228

§ 371 (c)(1),
(2) Date: Feb. 1, 2017

(87) PCT Pub. No.: WO2016/023393

PCT Pub. Date: Feb. 18, 2016

(65) Prior Publication Data

US 2017/0219296 A1 Aug. 3, 2017

(30) Foreign Application Priority Data

Aug. 12, 2014 (CN) ..... 2014 1 0395802

(51) Int. Cl.

| | |
|---|---|
| ***F28F 1/42*** | (2006.01) |
| ***F28F 3/04*** | (2006.01) |
| ***F28D 9/00*** | (2006.01) |

(52) U.S. Cl.

CPC ..... *F28F 3/048* (2013.01); *F28D 9/00* (2013.01); *F28F 3/04* (2013.01); *F28F 3/044* (2013.01); *F28F 3/046* (2013.01)

(58) Field of Classification Search

CPC .... F28F 3/048; F28F 3/08; F28F 3/005; F28F 2280/00; F28D 9/00; F28D 9/0062; F28D 9/005

(Continued)

(56) References Cited

U.S. PATENT DOCUMENTS 6,234,239 B1 * 5/2001 Azar ..... F28F 3/02 165/185
2004/0069473 A1 * 4/2004 Blomgren ..... F28D 9/005 165/167

(Continued)

FOREIGN PATENT DOCUMENTS

CN 101158561 A 4/2008
CN 102478368 A 5/2012

(Continued)

OTHER PUBLICATIONS

International Search Report for PCT Serial No. PCT/CN2015/080228 dated Jul. 10, 2015.

(Continued)

*Primary Examiner* — Davis Hwu
(74) *Attorney, Agent, or Firm* — McCormick, Paulding & Huber LLP

(57) ABSTRACT

Disclosed are a heat exchange plate (10) and a plate-type heat exchanger using the heat exchange plate (10). The heat exchange plate (10) comprises: a body; pits and/or protrusions (3), arranged on the surface of the body in predetermined patterns; and a plurality of adjusting portions (1, 2), wherein four quadrangular adjusting portions (1, 2) are arranged at the periphery of each pit and/or protrusion (3), then a basic heat transfer unit (4) is formed by each pit and/or protrusion (3) and the adjusting portions (1, 2) at the periphery thereof, and the adjusting portions (1, 2) in each basic heat transfer unit (4) are arranged to be provided with relatively large gaps in a main flow direction (D 1) of fluid (Continued)

on the heat exchange plate (10) and are arranged to be provided with relatively small gaps in an auxiliary flow direction (D2) of the fluid on the heat exchange plate (10).

19 Claims, 7 Drawing Sheets

(58) Field of Classification Search
USPC ..... 165/179
See application file for complete search history.

(56) References Cited

U.S. PATENT DOCUMENTS

| | | | | |
|---|---|---|---|---|
| 2007/0006998 | A1 | 1/2007 | Brost | |
| 2010/0126699 | A1 | 5/2010 | Lavric | |
| 2011/0180247 | A1 | 7/2011 | Persson | |
| 2012/0266599 | A1* | 10/2012 | Berger | B01D 1/22 60/716 |

FOREIGN PATENT DOCUMENTS

| | | | |
|---|---|---|---|
| CN | 102564176 | A | 7/2012 |
| CN | 104132576 | A | 11/2014 |
| CN | 204255163 | U | 4/2015 |
| DE | 102012217333 | A1 | 3/2014 |
| JP | 2008116138 | A | 5/2008 |
| KR | 20060086872 | A | 8/2006 |
| WO | 2004106835 | A2 | 12/2004 |

OTHER PUBLICATIONS

Supplementary European Search Report for Serial No. EP 15 83 2506 dated Feb. 2, 2018.

Korean Office Action for Serial No. 10-2017-7005990 dated Mar. 3, 2017.

* cited by examiner

HEAT EXCHANGE PLATE AND PLATE-TYPE HEAT EXCHANGER

CROSS-REFERENCE TO RELATED APPLICATIONS

This application is a National Stage application of International Patent Application No. PCT/CN2015/080228, filed on May 29, 2015, which claims priority to Chinese Patent Application No. 201410395802.7, filed on Aug. 12, 2014, each of which is hereby incorporated by reference in its entirety.

TECHNICAL FIELD

The disclosure of the present invention relates to the technical field of air conditioning and refrigeration, in particular to a heat exchange plate and a plate-type heat exchanger for use in this field.

BACKGROUND

In a plate-type heat exchanger, the performance and cost thereof are always two important factors. In the case of an existing plate-type heat exchanger, non-uniform distribution of fluid on the heat exchange plate surfaces thereof has a significant effect on the heat transfer performance, and worsens steadily as the width of the heat exchange plates increases.

In view of the above, there is definitely a need to provide a novel heat exchange plate and plate-type heat exchanger.

SUMMARY

The object of the present invention is to solve at least one aspect of the abovementioned problems and defects in the prior art.

In one aspect of the present invention, a heat exchange plate is provided, comprising:

a main body;

depressions and/or protrusions, arranged on a surface of the main body in a predetermined pattern;

multiple regulating parts, wherein four regulating parts forming a quadrilateral are disposed on the periphery of each depression and/or protrusion, whereby each depression and/or protrusion and the regulating parts on the periphery thereof form a basic heat transfer unit;

the regulating parts in each basic heat transfer unit are arranged to have a larger gap in a main flow direction of fluid on the heat exchange plate, and to have a smaller gap in a secondary flow direction of fluid on the heat exchange plate.

In one embodiment, the size of a flow cross section is adjusted by changing the gap between two adjacent regulating parts which are substantially parallel to the main flow direction, by changing the size of the regulating parts, or by changing the angle of each regulating part relative to the main flow direction, so as to achieve control of flow rate/flow speed distribution with different cross sections.

In one embodiment, the regulating parts are substantially S-shaped, 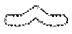 , 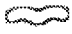 , 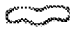 , 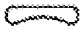 , 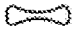 , 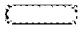 , 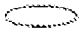 or 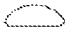 shaped.

In one embodiment, in each of the basic heat transfer units, the regulating parts are all elongated, wherein the regulating parts have the same shape or different shapes.

In one embodiment, in each of the basic heat transfer units, the four regulating parts are arranged substantially in the shape of a parallelogram.

In one embodiment, the depressions and/or protrusions have a larger dimension in the main flow direction than in the secondary flow direction.

In one embodiment, the regulating parts are arranged on the heat exchange plate in a substantially I-shaped, V shaped, W-shaped, V+W-shaped, W+W-shaped or V+A-shaped layout.

In one embodiment, the angle of the V shape is in the range of 90-150°.

In one embodiment, in at least one of the basic heat transfer units, at least one of the regulating parts is a connecting transition part for bringing about a smooth transition in the flow of fluid.

In one embodiment, the connecting transition part is disposed in a position where the main flow direction changes, and is an abnormally shaped regulating part with substantially a 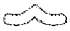 shape and/or a 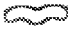 shape.

In one embodiment, in the case where depressions are disposed on the main body surface of the heat exchange plate, the regulating parts protrude outward from the main body surface; or in the case where protrusions are disposed on the main body surface of the heat exchange plate, the regulating parts are depressed inward from the main body surface.

In another aspect of the present invention, a plate-type heat exchanger is provided, comprising at least one heat exchange plate as claimed in any one of the preceding claims.

The present invention is a good solution to the two problems mentioned above concerning reliability and non-uniform fluid distribution. It offers the possibility of using a thinner material without losing reliability, and also makes a contribution to reducing costs.

The novel profile of depressions and/or protrusions proposed in the present invention can easily guide fluid to a side edge, such that the distribution of fluid along the heat exchange plate surface is better. At the same time, regulating parts with an S-shape, for example, can give rise to eddy currents in the fluid and enhance heat transfer. The novel layout of depressions and/or protrusions can reduce bypass flow of fluid, and can also improve heat transfer efficiency, without increasing the pressure drop.

The pattern of depressions and/or protrusions has good strength; as a result, it is possible to use a smaller thickness and reduce costs. However, in such a case, the fluid distribution therein is not very good; this leads to a corresponding problem with performance.

Thus, the heat exchange plate or plate-type heat exchanger of the present invention can provide good distribution, and has good performance and reliability.

The main concept of the present invention lies in the following:

1) forcing fluid to spread to side edges;

2) reducing back-and-forth flow during evaporation;

3) increasing turbulence and eddy currents in the case of regulating parts with an S-shape, for example, to achieve a high heat transfer efficiency;

4) reducing or eliminating bypass flow;

5) realizing a flexible, asymmetric design on a heat exchange plate on a refrigerant side and a water side;

6) using large welding points to increase the stress and strength on a high-pressure side.

BRIEF DESCRIPTION OF THE DRAWINGS

Embodiments of the present invention are now described, merely through examples, with reference to the accompanying schematic drawings, wherein corresponding drawing labels in the drawings indicate corresponding components.

FIG. 2F shows a flow distribution view of a basic heat transfer unit when a fluid is flowing through;

DETAILED DESCRIPTION

The technical solution of the present invention is explained in further detail below by means of embodiments, in conjunction with FIGS. 1A-2I. In this description, identical or similar drawing labels indicate identical or similar components. The following explanation of embodiments of the present invention with reference to the accompanying views is intended to explain the overall inventive concept of the present invention, and should not be interpreted as limiting the present invention.

In one embodiment of the present invention, a heat exchange plate is provided. The heat exchange plate comprises a main body, depressions and/or protrusions, and multiple regulating parts. The depressions and/or protrusions are arranged on a surface of the main body in a predetermined pattern. Four regulating parts forming a quadrilateral are disposed on the periphery of each depression and/or protrusion, whereby each depression and/or protrusion and the regulating parts on the periphery thereof form a basic heat transfer unit. The regulating parts in each basic heat transfer unit are arranged to have a larger gap in a main flow direction of fluid on the heat exchange plate, and to have a smaller gap in a secondary flow direction of fluid on the heat exchange plate.

Figure 1A:
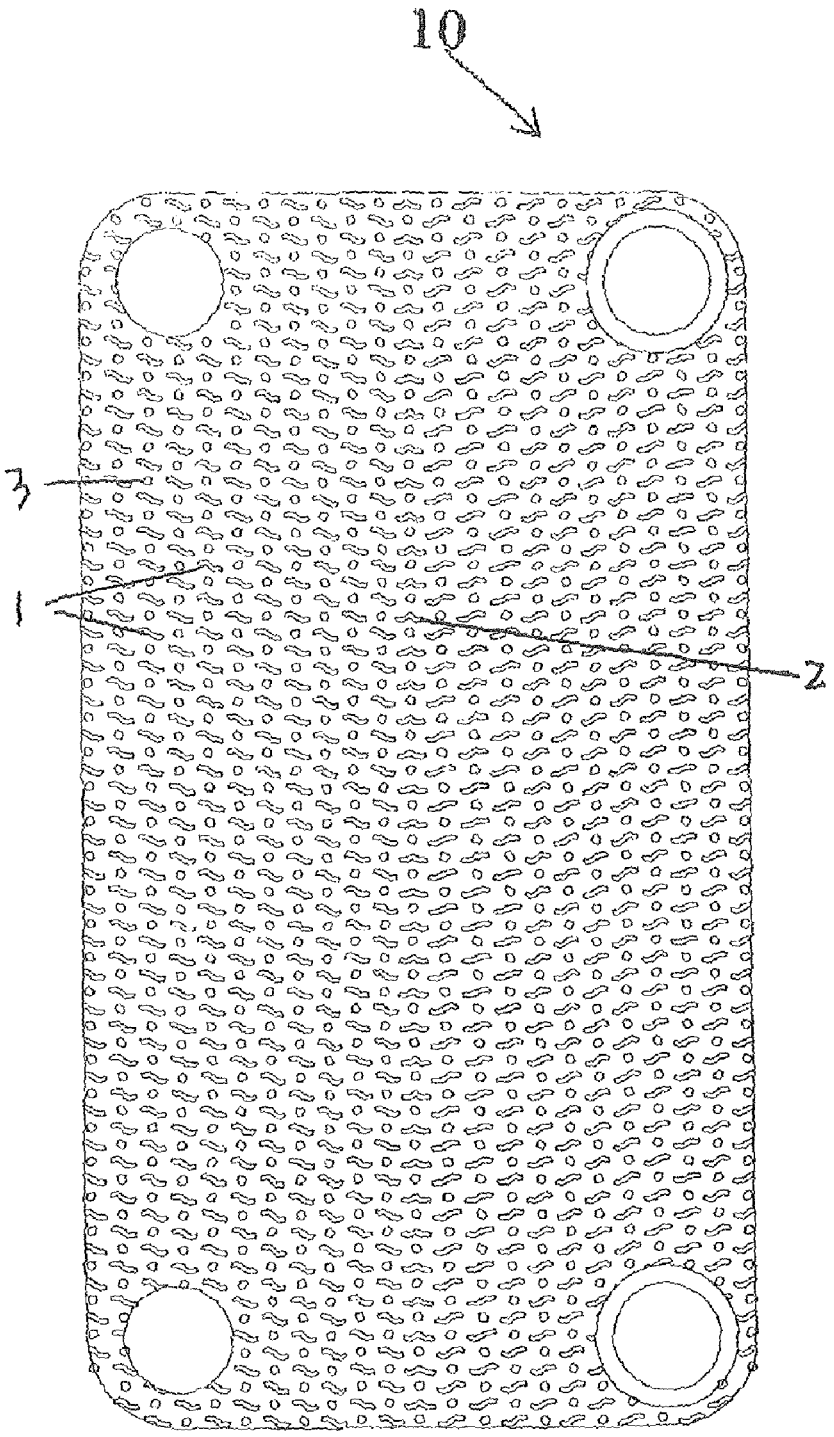
FIG. 1A shows a structural schematic diagram of a heat exchange plate having regulating parts according to an embodiment of the present invention, wherein the regulating parts are arranged in a V shape.
Figure 1B:
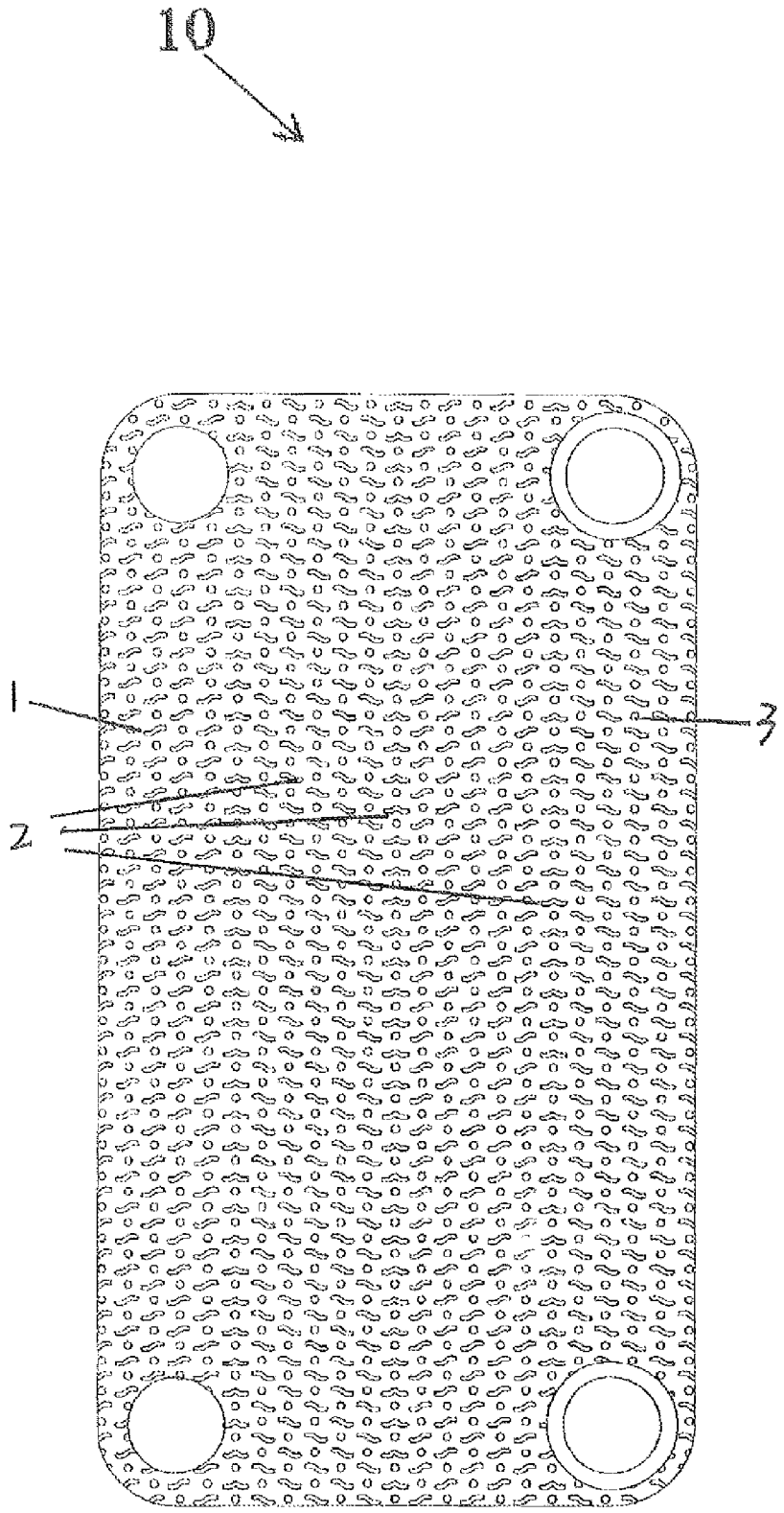
FIG. 1B shows a structural schematic diagram of a heat exchange plate having regulating parts according to another embodiment of the present invention, wherein the regulating parts are arranged in a W shape.

FIGS. 1*a* and 1*b* show embodiments of a heat exchange plate 10 in which regulating parts 1 and 2 are arranged in substantially a V shape and a W shape. Multiple regulating parts 1 and 2 are provided on a main body surface of the heat exchange plate 10. Each depression and/or protrusion 3 and the regulating parts 1, 2 on the periphery thereof form a basic heat transfer unit.

As can be understood by those skilled in the art, inlet/outlet holes for different working medium fluids may also be disposed on the main body surface of the heat exchange plate 10 (as shown by the four circles in the figures). The depressions and/or protrusions 3 may be selected according to actual requirements. In this example, multiple depressions 3 arranged in a predetermined pattern are disposed on the surface of the heat exchange plate 10 in the figure; the predetermined pattern may be selected according to actual requirements.

Figure 2A:
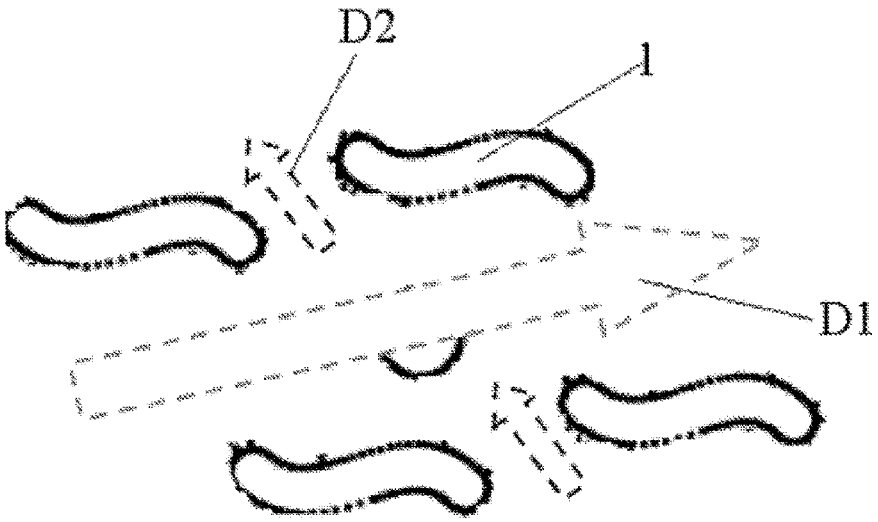
FIG. 2A shows a schematic diagram of a basic heat transfer unit having four regulating parts according to an embodiment of the present invention.
Figure 2B:
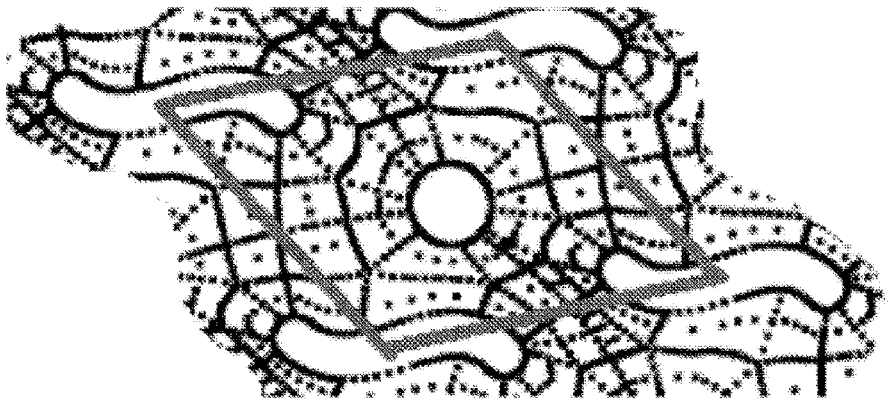
FIG. 2B shows a view of a basic heat transfer unit having four regulating parts on an actual heat exchange plate.

Four regulating parts 1 forming a quadrilateral (as shown in FIG. 2B) are disposed on the periphery of each depression 3, thus each depression 3 and the corresponding regulating parts 1 form a basic heat transfer unit 4.

To achieve a better heat transfer effect, as shown in FIGS. 2A and 2B, the regulating parts in each basic heat transfer unit are arranged to have a larger gap in a main flow direction D1 of fluid of the heat exchange plate 10, and to have a smaller gap in a secondary flow direction D2 of fluid of the heat exchange plate.

In the present invention, the regulating parts 1, 2 are both elongated. Of course, the regulating parts 1, 2 on the same surface of the heat exchange plate may have the same shape or different shapes. In multiple embodiments of the present invention, the shapes of the regulating parts 1, 2 may be substantially an S shape, 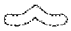 , 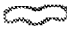 , 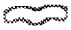 , 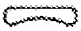 , 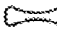 , 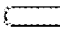 , 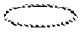 or 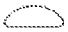 shape. In this example, multiple regulating parts 1, 2 with an S shape and a 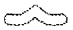 shape are shown.

Figure 2C:
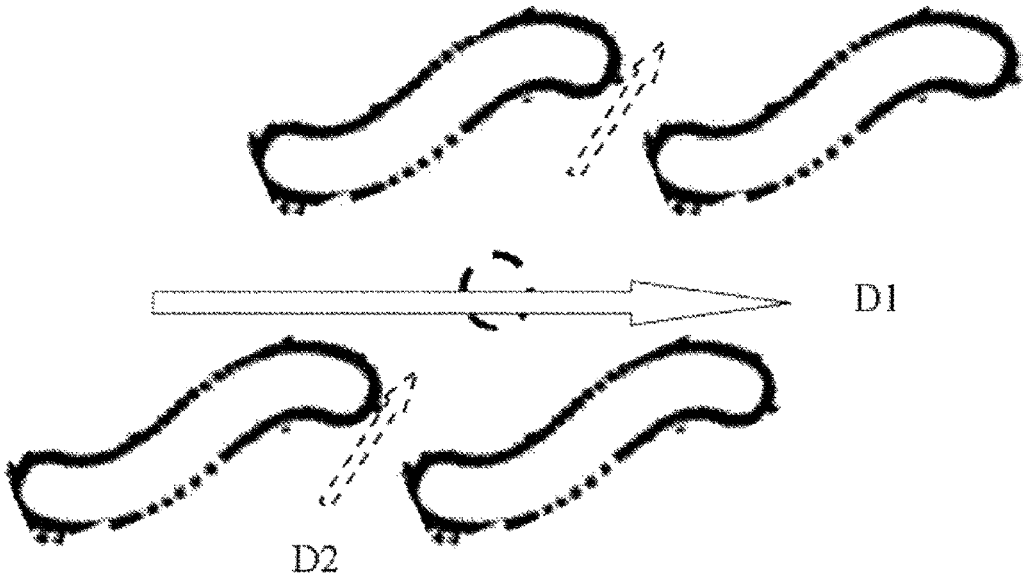
FIG. 2C shows a schematic diagram of a basic heat transfer unit according to another embodiment of the present invention.
Figure 2D:
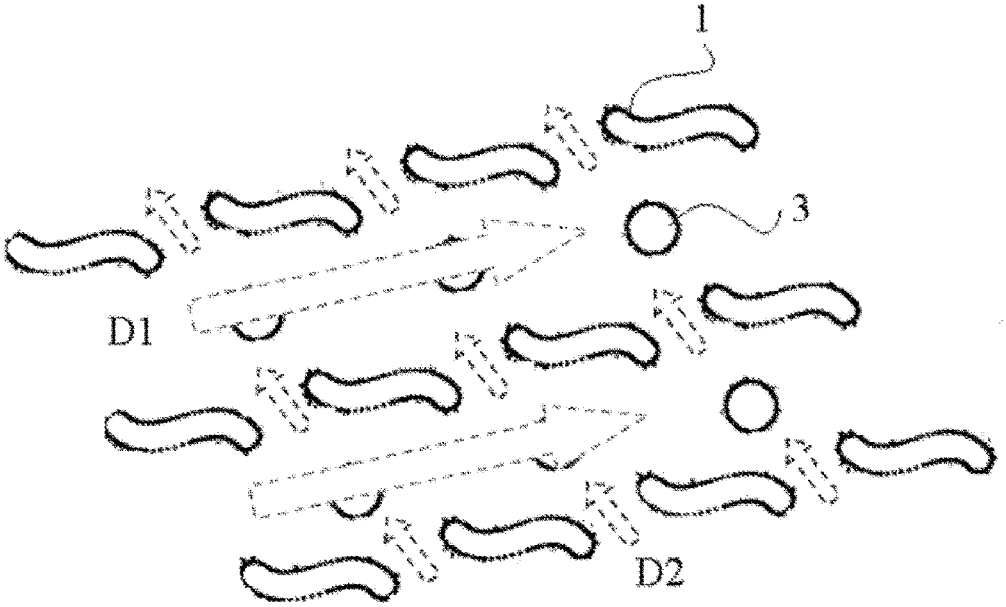
FIG. 2D shows a schematic diagram of multiple basic heat transfer units according to another embodiment of the present invention.

Obviously, the size of the flow cross section may be adjusted by changing the gap between two adjacent regulating parts 1, 2 which are substantially parallel to the main flow direction D1, by changing the size of the regulating parts 1, 2, or by changing the angle of each regulating part 1, 2 relative to the main flow direction D1, so as to achieve control of flow rate/flow speed distribution with different cross sections, as shown in FIGS. 2C and 2D.

In the present invention, by disposing the regulating parts 1, 2 on a two-phase side of the heat exchange plate 10, a flexible design is implemented on the side of a fluid such as water (e.g. a design that is asymmetric with respect to the two-phase side, or no regulating parts are disposed on the side of the fluid such as water). Here, the depressions and/or protrusions 3 of the regulating parts 1, 2, which have an S shape or another shape, may guide fluid to flow across the main flow direction with low pressure loss, at the same time giving rise to eddy currents for enhancing heat transfer, as shown in FIGS. 2E and 2F.

Figure 2E:
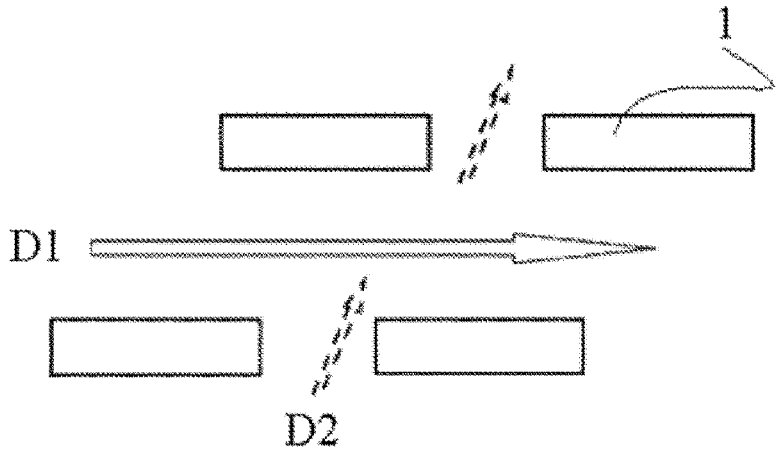
FIG. 2E shows a schematic view of a basic heat transfer unit according to the present invention.
Figure 2F:
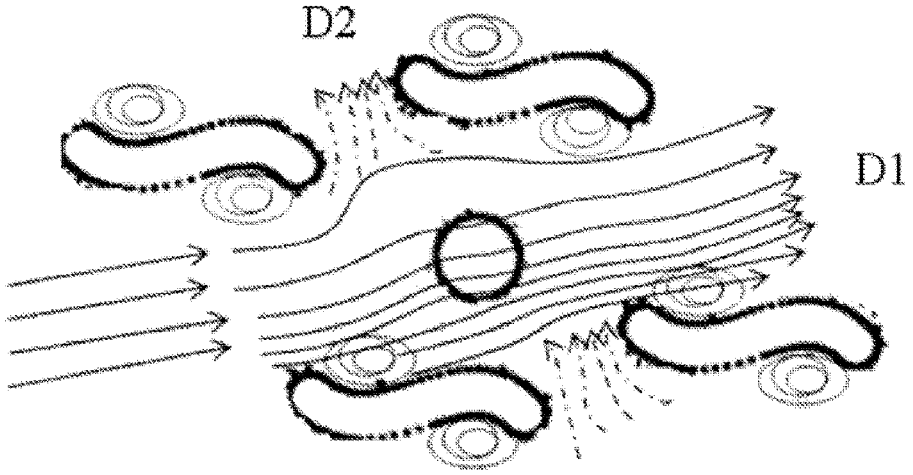

As shown in the schematic diagram in FIG. 2E, in each basic heat transfer unit, the four regulating parts 1 are arranged substantially in the shape of a parallelogram. Of course, the depressions and/or protrusions 3 may have a larger dimension in the main flow direction D1 than in the secondary flow direction D2. Of course, the shape of the regulating parts 1 is not restricted, and may be set as required.

In the case of a very wide plate, the flow in one direction is not sufficient to push the fluid flow to both sides effectively. In such cases, the layout of S-shaped regulating parts may be arranged in a V shape or W shape, to achieve a good fluid distribution. Thus, the design of the present invention, in relation to the regulating parts, is very flexible.

Figure 2G:
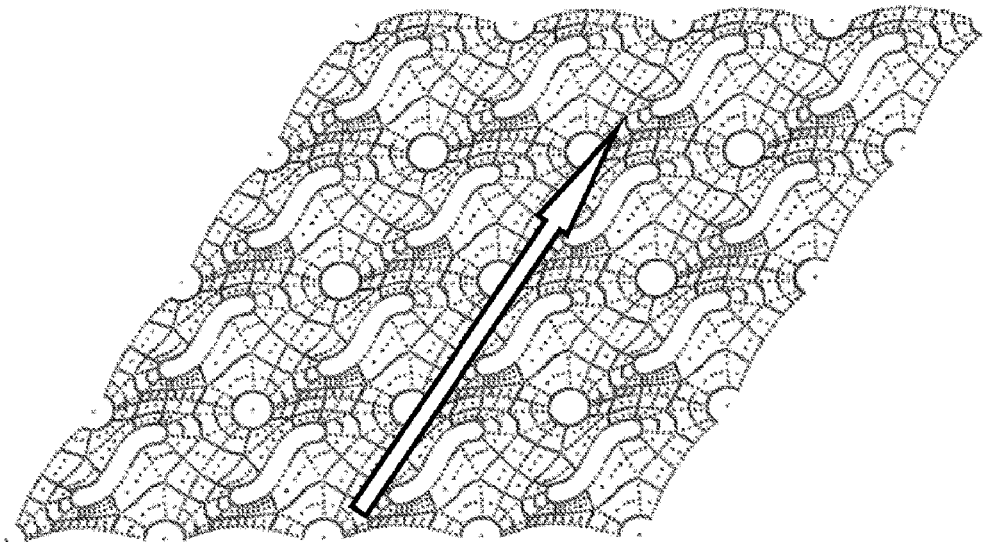
FIG. 2G shows a partial view of a heat exchange plate with the regulating parts arranged in an I shape.
Figure 2H:
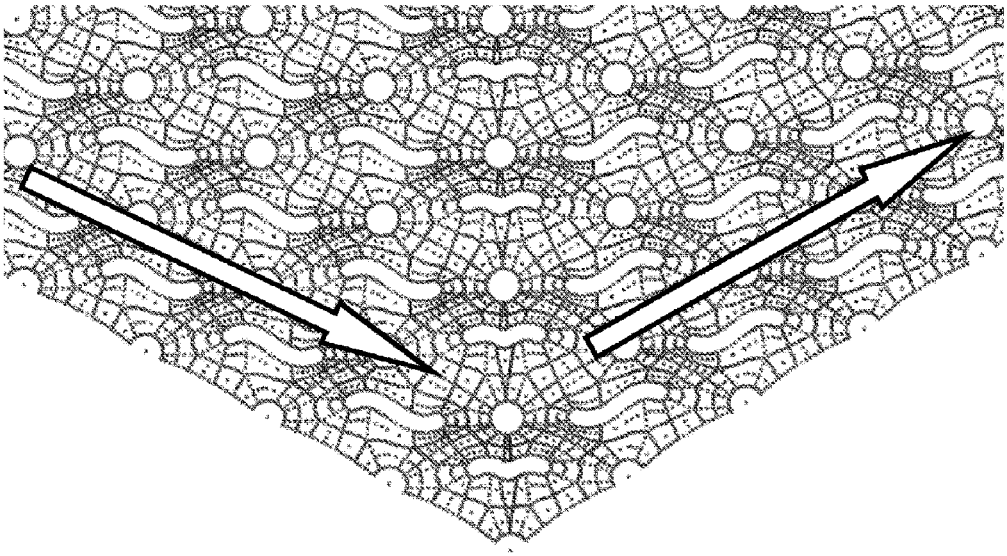
FIG. 2H shows a partial view of a heat exchange plate with the regulating parts arranged in a V shape.
Figure 2I:
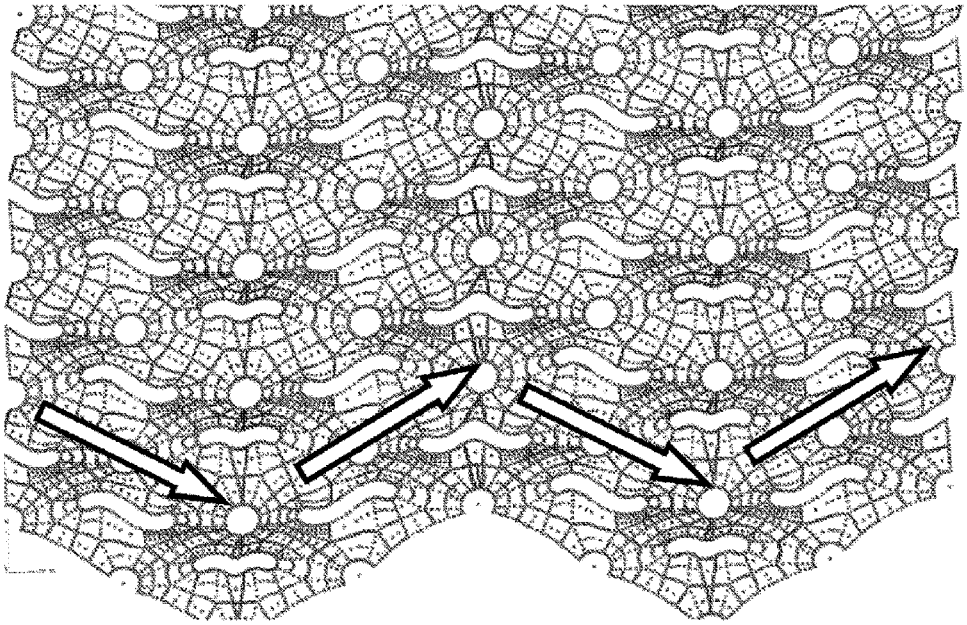
FIG. 2I shows a partial view of a heat exchange plate with the regulating parts arranged in a W shape.

FIGS. 2G, 2H and 2I show I-shaped, V-shaped and W-shaped layouts of the profiles of the regulating parts 1, 2.

Although FIGS. 2H and 2I show the regulating parts 1, 2 arranged in substantially V-shaped and W-shaped layouts, it can be understood that apart from this, the regulating parts 1, 2 could also be arranged on the heat exchange plate 10 in a substantially V-shaped, V+W-shaped, W+W-shaped or V+A-shaped layout.

In one embodiment, the angle of the V shape in the V-shaped layout is in the range of 90-150°.

It can be understood that in at least one of the basic heat transfer units, at least one regulating part (e.g. regulating part 2) is a connecting transition part for bringing about a smooth transition in the flow of fluid. The connecting transition part 2 is disposed in a position where the main flow direction changes, and is an abnormally shaped regulating part with substantially a 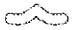 shape and/or a 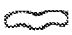 shape.

In an embodiment of the present invention, in the case where depressions 3 are disposed on the main body surface of the heat exchange plate 10, the regulating parts 1, 2 protrude outward from the main body surface; or in the case where protrusions are disposed on the main body surface of the heat exchange plate 10, the regulating parts 1, 2 are depressed inward from the main body surface.

As stated above, the layout of depressions and/or protrusions including S-shaped regulating parts, for example, may be arranged flexibly, to achieve a desired effective change in cross section.

FIG. 2B shows a schematic diagram of part of the pattern on the plate surface. A large gap is set in the main flow direction D1; this results in a low pressure drop in the main flow direction D1, and will push more fluid flow through the channel.

A small gap is set in the secondary flow direction D2; this results in higher pressure drop and resistance in the secondary flow direction D2 than in the main flow direction D1.

Depressions and/or protrusions are arranged on the heat exchange plate as shown in FIGS. 2C and 2D. Thus, the fluid first of all flows and spreads in a transverse direction, then flows upward in a longitudinal direction through a secondary flow channel.

The angle between the main flow direction and secondary flow direction may be adjusted and optimized to control the speed of fluid spread on the plate surface.

Generally, the depressions and/or protrusions should have a larger dimension in the longitudinal direction (main flow direction) than in the transverse direction (secondary flow direction), as shown in FIG. 2C. Of course, not all scenarios need be like this, i.e. the shape of the depressions and/or protrusions need not be constructed to have different cross-sectional areas in the main flow direction and secondary flow direction. In this example, S-shaped regulating parts are shown. The special S-shaped regulating part profile should be arranged to enhance heat transfer and guide the flow. FIG. 2F shows a basic flow and heat transfer unit.

With regard to reliability, the dimensions of the depressions and/or protrusions and the number of welding points in the present invention are larger than in the case of a herringbone pattern. As a result, the pattern according to the present invention can use a thinner plate material to achieve high pressure in comparison with an ordinary pattern of depressions and/or protrusions.

Furthermore, another embodiment of the present invention further provides a plate-type heat exchanger, comprising multiple heat exchange plates as described in any one of the embodiments above joined together one on top of another, and a channel for heat exchange fluid flow is formed in a space therebetween.

Specifically, the multiple heat exchange plates are joined together by brazing, semi-welding or full welding.

Furthermore, the multiple heat exchange plates may be joined together dismantlably.

The heat exchange plates and/or plate-type heat exchangers in multiple embodiments of the present invention can have at least one of the following advantages:

1. advantages identical to those of depression/protrusion patterns in the prior art, including but not limited to:
   - the welding area is increased by using a larger welding point size and a greater number of welding points, to improve strength;
   - lower raw material consumption and reduced costs.
2. a flow distribution identical or equal to that of a heat exchange plate with a herringbone pattern;
3. a high heat transfer efficiency is achieved by enhancing turbulence and eddy currents with a "circling (boomerang)" shape;
4. the stability of the evaporation process is improved, to reduce residue of fluid;
5. the same design flexibility as an ordinary pattern of depressions and/or protrusions, and greater flexibility than a herringbone pattern.

Although some embodiments of the overall inventive concept have been shown and explained, those skilled in the art will understand that changes may be made to these embodiments without departing from the principles and spirit of the overall inventive concept. The scope of the present invention is defined by the claims and their equivalents.

What is claimed is:

1. A heat exchange plate, comprising:

a main body;

depressions and/or protrusions, arranged on a surface of the main body in a predetermined pattern;

multiple regulating parts, wherein four regulating parts forming a quadrilateral are disposed on the periphery of each depression and/or protrusion, whereby each depression and/or protrusion and the regulating parts on the periphery thereof form a basic heat transfer unit;

the regulating parts in each basic heat transfer unit are arranged to have a larger gap in a main flow direction of fluid on the heat exchange plate, and to have a smaller gap in a secondary flow direction of fluid on the heat exchange plate;

wherein in the case where depressions are disposed on the main body surface of the heat exchange plate, the regulating parts protrude outward from the main body surface; or in the case where protrusions are disposed on the main body surface of the heat exchange plate, the regulating parts are depressed inward from the main body surface.

2. The heat exchange plate as claimed in claim 1, wherein the size of a flow cross section is adjusted by changing the gap between two adjacent regulating parts which are substantially parallel to the main flow direction, by changing the size of the regulating parts, or by changing the angle of each regulating part relative to the main flow direction, so as to achieve control of flow rate/flow speed distribution with different cross sections.

3. The heat exchange plate as claimed in claim 1, wherein the regulating parts are substantially S-shaped, 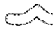 , 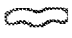 , 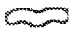 , 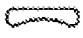 , 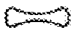 , 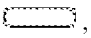 , 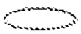 or 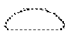 shaped.

4. The heat exchange plate as claimed in claim 1, wherein in each of the basic heat transfer units, the regulating parts are all elongated, wherein the regulating parts have the same shape or different shapes.

5. The heat exchange plate as claimed in claim 1, wherein in each of the basic heat transfer units, the four regulating parts are arranged substantially in the shape of a parallelogram.

6. The heat exchange plate as claimed in claim 1, wherein the depressions and/or protrusions have a larger dimension in the main flow direction than in the secondary flow direction.

7. The heat exchange plate as claimed in claim 1, wherein the regulating parts are arranged on the heat exchange plate in a substantially I-shaped, V-shaped, W-shaped, V+W-shaped, W+W-shaped or V+A-shaped layout.

8. The heat exchange plate as claimed in claim 7, wherein the angle of the V shape is in the range 90-150°.

9. The heat exchange plate as claimed in claim 7, wherein in at least one of the basic heat transfer units, at least one of the regulating parts is a connecting transition part for bringing about a smooth transition in the flow of fluid.

10. The heat exchange plate as claimed in claim 9, wherein the connecting transition part is disposed in a position where the main flow direction changes, and is an abnormally shaped regulating part with substantially a 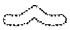 shape 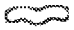 and/or a shape.

11. A plate-type heat exchanger, comprising at least one heat exchange plate as claimed in claim 1.

12. The heat exchange plate as claimed in claim 2, wherein the regulating parts are substantially S-shaped, 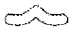 , 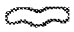 , 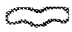 , 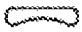 , 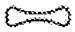 , 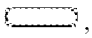 , 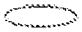 or 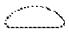 shaped.

13. The heat exchange plate as claimed in claim 2, wherein in each of the basic heat transfer units, the regulating parts are all elongated, wherein the regulating parts have the same shape or different shapes.

14. The heat exchange plate as claimed in claim 3, wherein in each of the basic heat transfer units, the regulating parts are all elongated, wherein the regulating parts have the same shape or different shapes.

15. The heat exchange plate as claimed in claim 2, wherein in each of the basic heat transfer units, the four regulating parts are arranged substantially in the shape of a parallelogram.

16. The heat exchange plate as claimed in claim 3, wherein in each of the basic heat transfer units, the four regulating parts are arranged substantially in the shape of a parallelogram.

17. The heat exchange plate as claimed in claim 4, wherein in each of the basic heat transfer units, the four regulating parts are arranged substantially in the shape of a parallelogram.

18. The heat exchange plate as claimed in claim 2, wherein the depressions and/or protrusions have a larger dimension in the main flow direction than in the secondary flow direction.

19. The heat exchange plate as claimed in claim 3, wherein the depressions and/or protrusions have a larger dimension in the main flow direction than in the secondary flow direction.

* * * * *